US010119186B2

(12) United States Patent
Sugiyama et al.

(10) Patent No.: US 10,119,186 B2
(45) Date of Patent: Nov. 6, 2018

(54) MARAGING STEEL EXCELLENT IN FATIGUE CHARACTERISTICS

(71) Applicants: Kenji Sugiyama, Aichi (JP); Shigeki Ueta, Aichi (JP)

(72) Inventors: Kenji Sugiyama, Aichi (JP); Shigeki Ueta, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 0 days.

(21) Appl. No.: 14/450,453

(22) Filed: Aug. 4, 2014

(65) Prior Publication Data

US 2015/0056093 A1 Feb. 26, 2015

(30) Foreign Application Priority Data

Aug. 23, 2013 (JP) ..... 2013-173761
May 22, 2014 (JP) ..... 2014-106152

(51) Int. Cl.

| | |
|---|---|
| ***C22C 38/00*** | (2006.01) |
| ***C22C 38/14*** | (2006.01) |
| ***C22C 38/50*** | (2006.01) |
| ***C22C 38/08*** | (2006.01) |
| ***C22C 38/12*** | (2006.01) |

(Continued)

(52) U.S. Cl.

CPC ..... *C22C 38/14* (2013.01); *C22C 38/001* (2013.01); *C22C 38/002* (2013.01); *C22C 38/004* (2013.01); *C22C 38/06* (2013.01); *C22C 38/08* (2013.01); *C22C 38/105* (2013.01); *C22C 38/12* (2013.01); *C22C 38/16* (2013.01); *C22C 38/28* (2013.01); *C22C 38/44* (2013.01);

(Continued)

(58) Field of Classification Search

CPC ... C22C 38/001; C22C 38/002; C22C 38/004; C22C 38/06; C22C 38/08; C22C 38/105; C22C 38/12; C22C 38/14; C22C 38/16; C22C 38/28; C22C 38/44; C22C 38/50; C22C 38/52; C22C 38/54

See application file for complete search history.

(56) References Cited

U.S. PATENT DOCUMENTS 3,453,102 A * 7/1969 Floreen ..... C22C 38/105 420/95
3,532,491 A 10/1970 Floreen et al.

(Continued)

FOREIGN PATENT DOCUMENTS

EP 0327042 8/1989
EP 1094125 4/2001

(Continued)

OTHER PUBLICATIONS

Extended European Search report for Application No. 14181989.6-1353, dated Feb. 25, 2015.

(Continued)

*Primary Examiner* — Colleen P Dunn
*Assistant Examiner* — Anthony M Liang
(74) *Attorney, Agent, or Firm* — Greenblum & Bernstein, P.L.C.

(57) ABSTRACT

Provided is a maraging steel excellent in fatigue characteristics, including, in terms of % by mass: C: ≤0.015%, Ni: from 12.0 to 20.0%, Mo: from 3.0 to 6.0%, Co: from 5.0 to 13.0%, Al: from 0.01 to 0.3%, Ti: from 0.2 to 2.0%, O: ≤0.0020%, N: ≤0.0020%, and Zr: from 0.001 to 0.02%, with the balance being Fe and unavoidable impurities.

6 Claims, 2 Drawing Sheets

MICROSCOPIC OBSERVATION
(ADDITIVE-FREE Zr)

(51) Int. Cl.

| | |
|---|---|
| ***C22C 38/16*** | (2006.01) |
| ***C22C 38/28*** | (2006.01) |
| ***C22C 38/44*** | (2006.01) |
| ***C22C 38/52*** | (2006.01) |
| ***C22C 38/54*** | (2006.01) |
| ***C22C 38/06*** | (2006.01) |
| ***C22C 38/10*** | (2006.01) |

(52) U.S. Cl.
CPC ..... *C22C 38/50* (2013.01); *C22C 38/52* (2013.01); *C22C 38/54* (2013.01)

(56) References Cited

U.S. PATENT DOCUMENTS

| | | | | |
|---|---|---|---|---|
| 4,832,909 | A | 5/1989 | Schmidt et al. | |
| 4,871,511 | A | 10/1989 | Smith, Jr. et al. | |
| 2007/0295430 | A1 | 12/2007 | Ueda et al. | |
| 2010/0200551 | A1* | 8/2010 | Nakajima ..... | B23K 26/0823 219/121.72 |
| 2012/0031529 | A1 | 2/2012 | Ohishi et al. | |

FOREIGN PATENT DOCUMENTS

| | | | |
|---|---|---|---|
| EP | 2412836 | | 2/2012 |
| JP | 549-042767 | B1 | 11/1974 |
| JP | 550-006168 | B1 | 3/1975 |
| JP | 51-087118 | | 7/1976 |
| JP | 53-030916 | | 3/1978 |
| JP | 58-025457 | | 2/1983 |
| JP | 104-116141 | | 4/1992 |
| JP | 107-211143 | | 8/1995 |
| JP | 07-243003 | | 9/1995 |
| JP | 2002-167652 | A | 6/2002 |
| JP | 2005-232551 | A | 9/2005 |
| JP | 2005-320611 | A | 11/2005 |
| JP | 2013-253277 | | 12/2013 |
| RO | 123056 | | 8/2010 |
| RU | 2334017 | | 9/2008 |

OTHER PUBLICATIONS

Lipp et al., "Schwingfestigkeitsverhalten von Martensitaushartendem Stahl mid rd. 18% Ni, 8% Co und 5% Mo," *Arch. Eisenhuttenwes*, vol. 47, No. 11, pp. 697-702, 1976.

Information Offer Form issued by Japan Patent Office in Japan Patent Application No. 2014-106152, dated Apr. 4, 2016, along with an English translation thereof.

Japanese Notification of Reasons for Refusal issued with respect to Application No. 2014-106152, dated Apr. 17, 201.

Japanese Office Action issued with respect to Application No. 2014-106152, dated Jul. 3, 2018.

* cited by examiner

MICROSCOPIC OBSERVATION
(ADDITIVE-FREE Zr)

SIZE OF NITRIDE (TiN)
(ADDITION OF Zr)

SIZE OF NITRIDE (TiN)
(ADDITIVE-FREE Zr)

MARAGING STEEL EXCELLENT IN FATIGUE CHARACTERISTICS

FIELD OF THE INVENTION

The present invention relates to a maraging steel. More specifically, the present invention relates to a maraging steel having fatigue characteristics improved by refining the size of a TiN inclusion.

BACKGROUND OF THE INVENTION

A maraging steel is a steel containing a large amount of Ni, Mo, Ti, Co, etc. as strengthening elements and is a steel of a type that undergoes age hardening in a martensitic state by heat treatment, and a maraging steel is an ultrahigh-strength steel capable of achieving a very high tensile strength of around 2,000 MPa.

Since a maraging steel has a high tensile strength, a maraging steel is used as a material suitable particularly for a member requiring high strength, such as aerospace or aircraft structural member, a continuously variable transmission component of an automotive engine, a high-pressure vessel, a tool material, a metal mold, etc.

The strengthening mechanism of a maraging steel is attributable to precipitation hardening of an intermetallic compound such as Ni—Ti and Ni—Mo in an aging treatment, and as a representative compositional example thereof, Fe-18Ni-9Co-5Mo-0.4Ti-0.1Al steel has been conventionally known.

However, a maraging steel has a problem that Ti added to steel reacts with N present in the steel to produce a coarse angular TiN inclusion and the TiN inclusion works out to a fracture origin and reduces the fatigue characteristics. Among others, the reduction in fatigue characteristics originated from a coarse TiN inclusion becomes a serious problem, for example, in thin steel sheet having a thickness of 0.5 mm or less, and it is required to solve this problem.

Incidentally, as a related art of the present invention, Patent Document 1 discloses an invention of "Method for Processing and Heat-Treating Maraging Steel", and a composition of a Zr-containing maraging steel is disclosed in claims thereof.

However, Patent Document 1 does not refer to Zr at all in description as well as in Examples where Zr must have added specifically, and differs from the present invention.

As another related art, Patent Document 2 discloses an invention of "Ultrahigh Tensile Strength High-Toughness Steel" and states in claim 2 that Zr can be added as a selective element. However, the steel described in Patent Document 2 has a low Ni content of 4.1 to 9.5 and in addition, Patent Document 2 describes no Example where Zr is added, and differs from the present invention.

As still another related art, Patent Document 3 discloses an invention of "Ultrahigh Strength Steel", and a composition containing Zr as one of selective elements is disclosed in claim 1 thereof. However, the steel described in Patent Document 3 has a Co content of 15.0 to 21.0, which is a high content compared with that of the present invention, and furthermore, the invention in Patent Document 3 differs from the present invention in that the reason for adding Zr is to enhance cleanliness by deoxygenation and enhance ductility by denitrogenation and prevention of grain boundary precipitation of Mo and Cr.

As yet still another related art, Patent Document 4 discloses an invention of "Maraging Steel Excellent in Heat Checking Resistance", and incorporation of Zr is disclosed in claim 1 thereof.

However, the steel described in Patent Document 4 has a low Ni content of 6.0 to 11.0, and the invention in Patent Document 4 differs from the present invention.

[Patent Document 1] JP-A-51-87118
[Patent Document 2] JP-A-53-30916
[Patent Document 3] JP-A-58-25457
[Patent Document 4] JP-A-7-243003

SUMMARY OF THE INVENTION

Under these circumstances, an object of the present invention is to provide a maraging steel having fatigue characteristics improved by refining the size of a TiN inclusion.

The present invention has adopted the following constitutions [1] and [2].

[1] A maraging steel excellent in fatigue characteristics, comprising, in terms of % by mass: C: ≤0.015%, Ni: from 12.0 to 20.0%, Mo: from 3.0 to 6.0%, Co: from 5.0 to 13.0%, Al: from 0.01 to 0.3%, Ti: from 0.2 to 2.0%, O: ≤0.0020%, N: ≤0.0020%, and Zr: from 0.001 to 0.02%, with the balance being Fe and unavoidable impurities.

[2] The maraging steel excellent in fatigue characteristics according to [1], further comprising one or more of, in terms of % by mass: B: from 0.0010 to 0.010%, Mg: ≤0.003%, and Ca: ≤0.003%.

DETAILED DESCRIPTION OF THE INVENTION

The gist of the present invention resides in adding a predetermined content of Zr as a component for refining the size of a TiN inclusion produced in a maraging steel.

In order to refine the size of a TiN inclusion, the present inventors have focused attention on a technique of forming nuclei of TiN in a finely dispersed manner before the formation of TiN and forming TiN around the nuclei.

Then, in order to explore whether an element capable of acting in such a way exists or not and if exists, what kind of an element can act so, a test of adding various elements was conducted to examine how TiN is formed.

As a result, the present inventors have found out the fact that as regards the elements examined, all elements except for Zr cannot effectively Rhin a nucleus contributing to the size refinement of a TiN inclusion and only Zr can form a nucleus effective in refining the size of a TiN inclusion.

The present invention has been accomplished based on the above-mentioned finding.

According to the estimation of the present inventors, when Zr is added to a molten steel during primary melting (when the melting ends only by primary melting, the primary melting becomes final melting), Zr added works out to a fine Zr inclusion (here, Zr oxide) and is produced in a dispersed manner in the molten steel.

When the molten steel is thereafter solidified, a TiN inclusion is crystallized around a large number of finely dispersed Zr inclusion nuclei.

More specifically, the produced nuclei are finely dispersed, and TiN is crystallized around each nucleus, as a result, the size of TiN crystallized product, namely, TiN inclusion that becomes a problem in a maraging steel, is refined.

In addition, at this time, Zr added to the molten steel acts to suppress TiN formation by causing N in the molten steel to be fixed as ZrN and reacting with Ti to reduce the amount of N for forming TiN.

Figure 3:
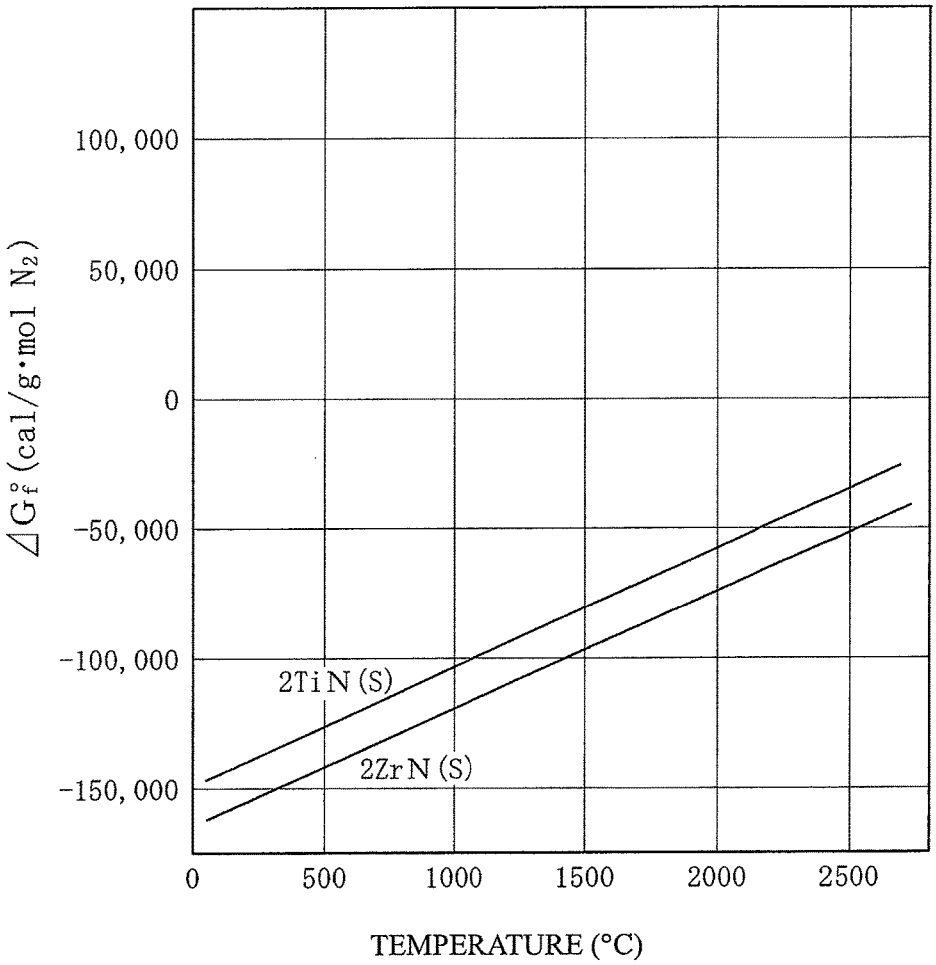
FIG. 3 is a view showing the standard free energies of formation of ZrN and TiN.

As shown in FIG. 3 (the source of FIG. 3 is Metal Data Book (edited by The Japan Institute of Metals and Materials), the standard free energy of formation of ZrN is smaller than the standard free energy of formation of TiN, and it is apparent from this relationship that when Zr and Ti are present together with N in a molten steel, the reaction of Zr with N can occur in preference to the reaction of Ti with N.

According to the present invention, the size of an angular-shaped TiN inclusion produced in a steel resulting from combining of Ti added to the steel with N can be refined, and the fatigue characteristics of a maraging steel can be thereby effectively enhanced.

The reasons for the limitations on the chemical components in the present invention are described below.

C: ≤0.015% by Mass

C combines with Ti to form carbide or carbonitride and is caused by an aging treatment to reduce the content of Ti which forms an intermetallic compound. Also, since the fatigue strength is reduced by the formation of carbide or carbonitride, the content of C is limited to be 0.015% by mass or less.

Ni: from 12.0 to 20.0% by Mass

Ni is caused by an aging treatment to precipitate an intermetallic compound such as $Ni_3Mo$ and NiAl, and enhance the tensile strength and fatigue strength. In order to obtain such an effect, the content of Ni is limited to 12.0% by mass or more.

On the other hand, if the content of Ni becomes excessive, the content of residual austenite is increased due to drop of the Ms temperature, whereby a sufficient martensite is not obtained. Therefore, the content of Ni is limited to 20.0% by mass or less.

Mo: from 3.0 to 6.0% by Mass

Mo contributes to enhancement of the base metal strength by precipitating an intermetallic compound such as $Ni_3Mo$. In order to obtain such an effect, the content of Mo is limited to 3.0% by mass or more.

On the other hand, if the content of Mo becomes excessive, the ductility is greatly reduced. Therefore, the content of Mo is limited to 6.0% by mass or less.

Co: from 5.0 to 13.0% by Mass

Co forms a solid solution in the matrix to thereby reduce the solid solution amount of the intermetallic compound-forming element Ni or Mo into martensite and promote the precipitation of $Ni_3Mo$ or NiAl. As a result, the tensile strength and fatigue strength are enhanced. For fulfilling such a function, the content of Co is limited to 5.0% by mass or more.

On the other hand, in the case where the content of Co is higher than 13.0% by mass, martensite transformation is inhibited due to drop of the Ms temperature, and the amount of residual austenite after solution heat treatment is increased to cause reduction in the strength. Therefore, the content of Co is limited to 13.0% by mass or less.

Al: from 0.01 to 0.3% by Mass

Al acts as a deoxygenation material during melting process of steel and thereby to reduce the oxygen content in the steel. Also, this element has a function of combining with Ni in an aging treatment to precipitate an NiAl intermetallic compound and in turn, enhance the tensile strength and fatigue strength. In order to obtain these effects, the content of Al is limited to 0.01% by mass or more.

On the other hand, in the case where the content of Al becomes excessive, Al forms an oxide to deteriorate the cleanliness and reduce the fatigue strength. For this reason, the content of Al is limited to 0.3% by mass or less.

Ti: from 0.2 to 2.0% by Mass

Ti forms an intermetallic compound such as $Ni_3Ti$ in an aging treatment, whereby the strength can be expected to be enhanced. In order to obtain this effect, the content of Ti is limited to 0.2% by mass or more.

On the other hand, Ti forms a Ti-based inclusion to deteriorate the cleanliness and reduce the fatigue strength. For this reason, the content of Ti is limited to 2.0% by mass or less.

O: ≤0.0020% by Mass

O forms an oxide such as $SiO_2$ and $Al_2O_3$ to reduce the fatigue strength. Therefore, the content of O is preferably as small as possible. However, an excessive decrease in the content of O causes a rise of the production cost. For this reason, the content of O is limited to 0.0020% by mass. The content of O is more preferably 0.0010% by mass or less.

N: ≤0.0020% by Mass

N forms nitride such as TiN and AlN to reduce the fatigue strength. Therefore, the content of N is preferably as small as possible. However, an excessive decrease in the content of N causes a rise of the production cost. For this reason, the content of N is limited to 0.0020% by mass. The content of N is more preferably 0.0010% by mass or less.

Zr: from 0.001 to 0.02% by Mass

Zr forms a nucleus of nitride or carbonitride such as TiN and refines the size of a TiN inclusion. In order to obtain this effect, the content of Zr is limited to 0.001% by mass or more.

On the other hand, excessive addition of Zr leads to reduction in the ductility. For this reason, the content of Zr is limited to 0.02% by mass or less. The content of Zr is preferably from 0.001 to 0.008% by mass.

B: from 0.0010 to 0.010% by Mass

B is an element effective in enhancing the hot workability of steel and therefore, may be added. This effect starts appearing with a content of 0.0010% by mass, but excessive addition causes formation of a boride having a low melting point at the grain boundary to deteriorate the cleanliness of steel and reduce the fatigue strength. For this reason, the content of B is limited to 0.010% by mass or less.

Mg: ≤0.003% by Mass

Ca: ≤0.003% by Mass

Mg and Ca are elements effective in enhancing the hot workability of steel and therefore, may be added. However, excessive addition may cause formation of an oxide to deteriorate the cleanliness of steel and reduce the fatigue strength. For this reason, the content of Mg and Ca is limited to 0.003% by mass or less, respectively.

EXAMPLES

Working examples of the present invention are described in detail below.

A 150 kg of steel having a chemical composition shown in Table 1 was melted in a high-frequency vacuum induction furnace and cast to obtain a steel ingot, and this ingot was used as an electrode for secondary melting.

A 20 mm portion on the top side and a 20 mm portion on the bottom side of this electrode were removed by cutting, respectively, and the surface layer was removed by shaving to a depth of 2.5 mm.

Using the thus-trimmed electrode, vacuum arc re-melting was carried out to melt the electrode, and casting was subsequently performed to obtain an ingot after secondary melting.

TABLE 1

| | | Chemical Composition (% by mass) | | | | | | | | | | | | |
|---|---|---|---|---|---|---|---|---|---|---|---|---|---|---|
| | | C | Ni | Mo | Co | Al | Ti | N | O | Zr | B | Mg | Ca | Fe |
| Ex. | 1 | 0.004 | 18.7 | 5.0 | 9.4 | 0.13 | 0.46 | 0.0005 | 0.0005 | 0.005 | | | | balance. |
| | 2 | 0.005 | 12.5 | 4.9 | 9.0 | 0.10 | 0.41 | 0.0007 | 0.0006 | 0.003 | | | | balance. |
| | 3 | 0.004 | 16.2 | 4.9 | 9.5 | 0.11 | 0.48 | 0.0009 | 0.0006 | 0.001 | | | | balance. |
| | 4 | 0.003 | 19.4 | 5.1 | 9.0 | 0.08 | 0.47 | 0.0005 | 0.0005 | 0.002 | | | | balance. |
| | 5 | 0.006 | 18.1 | 3.2 | 9.1 | 0.11 | 0.45 | 0.0007 | 0.0009 | 0.002 | | | | balance. |
| | 6 | 0.006 | 18.5 | 5.7 | 9.1 | 0.10 | 0.44 | 0.0011 | 0.0005 | 0.002 | | | | balance. |
| | 7 | 0.006 | 18.8 | 4.8 | 6.1 | 0.14 | 0.46 | 0.0009 | 0.0010 | 0.002 | | | | balance. |
| | 8 | 0.003 | 17.2 | 4.6 | 10.1 | 0.12 | 0.43 | 0.0012 | 0.0006 | 0.003 | | | | balance. |
| | 9 | 0.007 | 17.1 | 4.9 | 12.7 | 0.15 | 0.41 | 0.0006 | 0.0013 | 0.002 | | | | balance. |
| | 10 | 0.004 | 18.9 | 5.0 | 9.1 | 0.10 | 0.48 | 0.0014 | 0.0006 | 0.002 | | | | balance. |
| | 11 | 0.004 | 17.9 | 4.5 | 9.4 | 0.24 | 0.43 | 0.0008 | 0.0005 | 0.002 | | | | balance. |
| | 12 | 0.005 | 18.5 | 5.0 | 9.4 | 0.10 | 0.45 | 0.0005 | 0.0005 | 0.002 | | | | balance. |
| | 13 | 0.005 | 18.7 | 4.9 | 9.3 | 0.14 | 1.39 | 0.0005 | 0.0008 | 0.003 | | | | balance. |
| | 14 | 0.007 | 17.5 | 4.8 | 9.2 | 0.15 | 0.44 | 0.0006 | 0.0012 | 0.002 | | | | balance. |
| | 15 | 0.009 | 18.2 | 5.0 | 9.4 | 0.08 | 0.43 | 0.0015 | 0.0007 | 0.002 | | | | balance. |
| | 16 | 0.004 | 18.4 | 4.6 | 9.1 | 0.09 | 0.45 | 0.0006 | 0.0005 | 0.002 | | | | balance. |
| | 17 | 0.003 | 18.9 | 5.3 | 9.5 | 0.12 | 0.46 | 0.0012 | 0.0015 | 0.003 | | | | balance. |
| | 18 | 0.003 | 18.4 | 4.8 | 9.5 | 0.11 | 0.46 | 0.0010 | 0.0006 | 0.005 | | | | balance. |
| | 19 | 0.004 | 18.2 | 5.5 | 9.2 | 0.08 | 0.48 | 0.0012 | 0.0011 | 0.015 | | | | balance. |
| | 20 | 0.005 | 18.6 | 5.0 | 9.4 | 0.13 | 0.48 | 0.0005 | 0.0008 | 0.005 | 0.015 | | | balance. |
| | 21 | 0.004 | 18.7 | 5.0 | 9.5 | 0.13 | 0.46 | 0.0005 | 0.0005 | 0.005 | | 0.0011 | | balance. |
| | 22 | 0.005 | 18.6 | 5.0 | 9.5 | 0.13 | 0.46 | 0.0005 | 0.0005 | 0.005 | | | 0.0025 | balance. |
| | 23 | 0.004 | 18.4 | 5.0 | 9.2 | 0.13 | 0.46 | 0.0004 | 0.0005 | 0.006 | | | | balance. |
| | 24 | 0.004 | 18.3 | 5.0 | 9.3 | 0.13 | 0.46 | 0.0003 | 0.0006 | 0.008 | | | | balance. |
| Com. | 1 | 0.030 | 18.2 | 5.1 | 9.0 | 0.05 | 0.44 | 0.0014 | 0.0005 | 0.003 | | | | balance. |
| Ex. | 2 | 0.005 | 8.1 | 5.2 | 9.4 | 0.10 | 0.45 | 0.0015 | 0.0006 | 0.002 | | | | balance. |
| | 3 | 0.010 | 23.1 | 4.9 | 9.5 | 0.15 | 0.49 | 0.0009 | 0.0005 | 0.002 | | | | balance. |
| | 4 | 0.006 | 18.8 | 2.1 | 9.3 | 0.13 | 0.44 | 0.0007 | 0.0006 | 0.002 | | | | balance. |
| | 5 | 0.011 | 18.3 | 8.2 | 8.8 | 0.09 | 0.43 | 0.0009 | 0.0006 | 0.004 | | | | balance. |
| | 6 | 0.003 | 18.5 | 5.1 | 3.1 | 0.13 | 0.43 | 0.0010 | 0.0008 | 0.003 | | | | balance. |
| | 7 | 0.006 | 18.9 | 5.1 | 15.1 | 0.14 | 0.5 | 0.0010 | 0.0009 | 0.005 | | | | balance. |
| | 8 | 0.006 | 17.8 | 5.2 | 9.3 | 0.005 | 0.49 | 0.0008 | 0.0013 | 0.004 | | | | balance. |
| | 9 | 0.008 | 17.3 | 4.8 | 9.3 | 0.50 | 0.49 | 0.0007 | 0.0011 | 0.004 | | | | balance. |
| | 10 | 0.005 | 18.5 | 4.9 | 9.6 | 0.15 | 0.04 | 0.0006 | 0.0013 | 0.003 | | | | balance. |
| | 11 | 0.015 | 18.8 | 5.0 | 9.2 | 0.16 | 2.11 | 0.0007 | 0.0009 | 0.004 | | | | balance. |
| | 12 | 0.004 | 18.9 | 4.9 | 9.3 | 0.12 | 0.48 | 0.0022 | 0.0009 | 0.003 | | | | balance. |
| | 13 | 0.005 | 18.9 | 4.9 | 9.4 | 0.11 | 0.41 | 0.0011 | 0.0021 | 0.002 | | | | balance. |
| | 14 | 0.005 | 18.2 | 5.0 | 9.5 | 0.14 | 0.45 | 0.0009 | 0.0008 | <0.001 | | | | balance. |
| | 15 | 0.004 | 18.2 | 5.0 | 9.4 | 0.14 | 0.44 | 0.0012 | 0.0005 | 0.023 | | | | balance. |

Ex.: Example, Com. Ex.: Comparative Example

The ingot was forged, further hot-rolled to a thickness of 3 mm (3 mmT), then annealed under the condition of 650° C.×8 hr, subsequently cold-rolled to 0.32 mmT, and subjected to solid solution formation/heat treatment at 900° C. and aging treatment under the condition of 480° C.×3 hr.

For this steel subjected to aging treatment, the following tensile test, hardness test, fatigue test and chemical extraction test were performed. Also, for the steel after hot rolling, microscopic observation was performed.

Each of the microscopic observation, tensile test, hardness test, fatigue test and chemical extraction test was performed as follows.

[Microscopic Observation]

A test piece was sampled from the material after hot rolling and observed for an inclusion on the longitudinal cross-section by SEM (scanning electron microscope). Also, identification of the inclusion was performed by EDX (energy dispersive X-ray analysis).

[Tensile Test]

The tensile test was performed in accordance with the metal tensile test method of JIS Z 2241 (2011). As the test piece, a No. 13B test piece by JIS Z 2201 (2005) was employed. The test temperature was set to room temperature.

[Hardness Test]

The test was performed in accordance with the Vickers hardness test method provided in JIS Z 2244 (2009). The sample was measured under a load of 4.9 N, and the measurement site was set to a position of ½ the sample thickness. An average value of 5 points was employed as the measured value.

[Fatigue Test]

The fatigue characteristics were examined in accordance with general rules for the fatigue test method of metal materials of JIS Z 2273 (2010). Specifically, vibration was applied to the test piece under the conditions of an amplitude stress of 850 N/mm$^2$ in terms of alternating oscillation and a vibration rate of 1,200 rpm to repeatedly cause bending deformation of the test piece, and the number of repeated vibrations (deformations) until reaching a fracture was measured.

The evaluation of fatigue characteristics was rated "A" when the number of repetitions was $10^7$ or more, and rated "B" when less than $10^7$. Incidentally, the test specimen had a profile of 0.32 mmT×10 mmW×100 mmL.

[Chemical Extraction Test]

A plurality of 0.32 mmT test pieces of 15 mm×15 mm were sampled, and attachments and the like on the surface layer were removed by pickling. The test piece was subjected to chemical dissolution with 5 g in total of bromine and methanol, and extraction of inclusions was performed by an extraction filter having a pore size ϕ of 5 μm. The extracted residue was observed by SEM, and the shape and size of the inclusion were measured. Also, the identification of the inclusion was performed by EDX.

The long side a and short side b of nitride or carbonitride were measured, and the size of the carbonitride-based inclusion was evaluated by the maximum size of the long side a.

These results are shown in Table 2.

Figure 1:
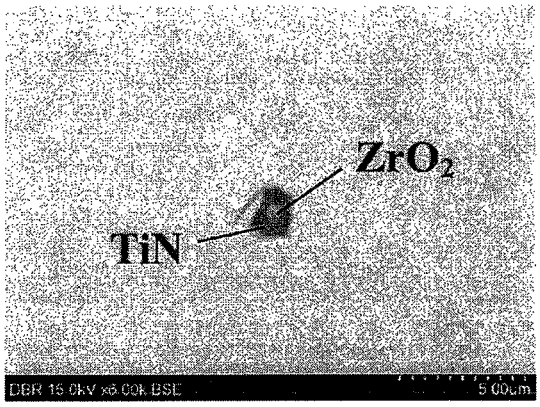
FIG. 1 is a view showing a result of SEM observation in Example 1.
Figure 2A:
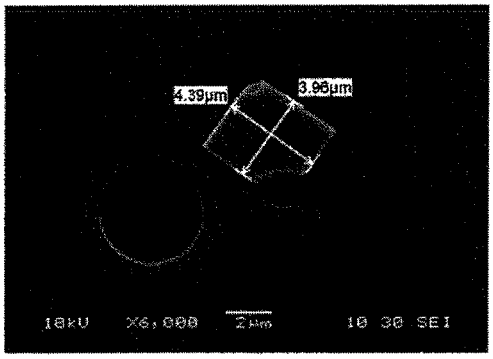
FIGS. 2A and 2B are views showing a TiN inclusion in Example 1 together with a TiN inclusion of Comparative Example 14.
Figure 2B:
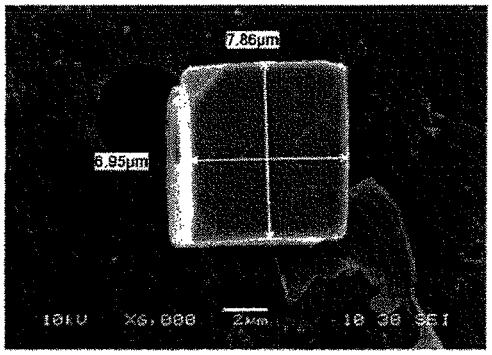

Furthermore, FIG. 1 shows the microscopic observation results of Example 1 as a representative of Examples 1 to 24. FIG. 2A shows the results of chemical extraction test, and in addition, FIG. 2B shows the results of chemical extraction test (results of observation by SEM) of Comparative Example 14.

Incidentally, in Table 2, the carbonitride-based inclusion is a Ti carbonitride-based inclusion and in all planar views, its shape is a square or substantially square angular shape.

TABLE 2

| | | Tensile Test | | | | | Maximum Length of |
|---|---|---|---|---|---|---|---|
| | | Proof Stress (MPa) | Strength (MPa) | Elongation (%) | Hardness (HV) | Fatigue Characteristics | Carbonitride-Based Inclusion (μm) |
| Ex. | 1 | 1819 | 1860 | 11 | 498 | A | 4.4 |
| | 2 | 1780 | 1821 | 12 | 471 | A | 5.2 |
| | 3 | 1797 | 1845 | 9 | 471 | A | 5.4 |
| | 4 | 1861 | 1891 | 10 | 529 | A | 4.8 |
| | 5 | 1766 | 1805 | 9 | 484 | A | 5.0 |
| | 6 | 1880 | 1930 | 9 | 545 | A | 5.1 |
| | 7 | 1778 | 1812 | 10 | 458 | A | 4.7 |
| | 8 | 1856 | 1883 | 9 | 471 | A | 5.5 |
| | 9 | 1880 | 1935 | 8 | 545 | A | 4.8 |
| | 10 | 1809 | 1848 | 12 | 484 | A | 5.7 |
| | 11 | 1873 | 1905 | 8 | 545 | A | 5.0 |
| | 12 | 1816 | 1857 | 9 | 471 | A | 4.2 |
| | 13 | 2084 | 2139 | 8 | 615 | A | 4.5 |
| | 14 | 1838 | 1865 | 10 | 484 | A | 5.0 |
| | 15 | 1837 | 1880 | 10 | 484 | A | 6.1 |
| | 16 | 1832 | 1867 | 10 | 498 | A | 4.6 |
| | 17 | 1796 | 1835 | 9 | 513 | A | 5.4 |
| | 18 | 1819 | 1867 | 10 | 513 | A | 5.4 |
| | 19 | 1829 | 1854 | 10 | 484 | A | 5.7 |
| | 20 | 1825 | 1868 | 8 | 498 | A | 5.5 |
| | 21 | 1843 | 1886 | 10 | 498 | A | 4.5 |
| | 22 | 1803 | 1851 | 12 | 498 | A | 5.8 |
| | 23 | 1820 | 1869 | 11 | 499 | A | 4.8 |
| | 24 | 1824 | 1860 | 12 | 500 | A | 4.7 |
| Com. | 1 | 1858 | 1892 | 7 | 513 | B | 5.5 |
| Ex | 2 | 1663 | 1710 | 9 | 440 | B | 5.2 |
| | 3 | 1635 | 1690 | 7 | 484 | B | 4.8 |
| | 4 | 1542 | 1570 | 13 | 402 | B | 4.5 |
| | 5 | 1789 | 1830 | 4 | 485 | A | 5.0 |
| | 6 | 1629 | 1650 | 12 | 422 | B | 5.5 |
| | 7 | 1710 | 1734 | 10 | 470 | B | 5.3 |
| | 8 | 1696 | 1730 | 10 | 458 | B | 4.7 |
| | 9 | 1759 | 1808 | 10 | 480 | B | 5.0 |
| | 10 | 1706 | 1734 | 10 | 484 | B | 4.4 |
| | 11 | 2376 | 2410 | 3 | 675 | B | 4.6 |
| | 12 | 1742 | 1770 | 8 | 484 | B | 8.8 |
| | 13 | 1767 | 1790 | 8 | 484 | B | 6.0 |
| | 14 | 1815 | 1855 | 11 | 458 | B | 7.9 |
| | 15 | 1815 | 1850 | 5 | 471 | B | 6.2 |

Ex.: Example, Com. Ex.: Comparative Example

In FIG. 1, it is seen that a Zr inclusion ($ZrO_2$) is present in the center part of the inclusion TiN, that is, the inclusion TiN is thinned around $ZrO_2$ serving as a nucleus.

Also, in FIGS. 2A and 2B, it is seen that in Example 1 where Zr is added, the size of the TiN inclusion is small owing to the addition of Zr (FIG. 2A) but in Comparative Example 14 where Zr is not added, a large-size TiN inclusion (FIG. 2B) is produced.

Here, in FIGS. 2A and 2B, the rounded black-looking portion is a pore of the extraction filter, and the portion looking black as the ground color is the extraction filter itself.

As regards the results of Table 2, in Comparative Example 1, formation of carbide or carbonitride is thought to be promoted due to a large C amount and in turn, the fatigue characteristics are poor.

In Comparative Examples 2, 4, 6, 8 and 10 where respectively the amounts of Ni, Mo, Co, Al and Ti are small, respectively, a sufficient intermetallic compound is not precipitated by an aging treatment and in turn, the tensile strength and fatigue characteristics are poor.

In Comparative Examples 3 and 7 where the amounts of Ni and Co are large, respectively, it is thought that an austenite phase was stabilized and a sufficient martensite texture was not obtained. In turn, the tensile strength and fatigue characteristics are poor.

In Comparative Example 5 where the content of Mo is large, the tensile strength and fatigue characteristics are good owing to aging/hardening, but reduction in the ductility is great.

In Comparative Example 9 where the content of Al is large, an oxide is thought to be readily formed, leading to decrease in the cleanliness. As a result, an inclusion works out to a fracture origin and in turn, the fatigue characteristics are poor.

In Comparative Example 12 where the content of N is large, the formed nitride and carbonitride grow into a coarse diameter, and a fatigue is generated from a carbonitride origin, as a result, the fatigue characteristics are deteriorated.

In Comparative Example 13 where the content of O is large, a O-containing nonmetallic inclusion is readily formed, and the fatigue characteristics are deteriorated.

In Comparative Example 14 where the content of Zr is small, the TiN diameter becomes coarse and in turn, the fatigue characteristics are deteriorated. In Comparative Example 15 where the content of Zr is large, the ductility is deteriorated.

On the other hand, in Examples 1 to 24 where the content of Zr is adjusted to fall in the range of 0.001 to 0.02% and each component of C, Ni, Mo, Co, Al, Ti, N and O is incorporated in a predetermined proper content, since a TiN inclusion is produced using a Zr-based oxide as a nucleus, the size of the TiN inclusion is refined and the fatigue characteristics and other properties are excellent.

While the mode for carrying out the present invention has been described in detail above, the present invention is not limited to these embodiments, and various changes and modifications can be made therein without departing from the purport of the present invention.

Incidentally, this application is based on Japanese patent application No. 2013-173761 filed Aug. 23, 2013 and Japanese patent application No. 2014-106152 filed May 22, 2014, and the entire contents thereof being hereby incorporated by reference.

What is claimed is:

1. A maraging steel, consisting of, in terms of % by mass:
C: ≤0.015%,
Ni: 12.0 to 20.0%,
Mo: 3.0 to 6.0%,
Co: 5.0 to 13.0%,
Al: 0.01 to 0.3%,
Ti: 0.2 to 2.0%,
O: ≤0.0020%,
N: 0.0005 to 0.0020%,
Zr: from 0.001 to 0.02%, and optionally one or more of:
B: from 0.0010 to 0.010%,
Mg: ≤0.003%, and
Ca: ≤0.003%
with the balance being Fe and unavoidable impurities,
wherein the maraging steel comprises at least one TiN or TiCN inclusion with $ZrO_2$ present in a center part thereof.

2. The maraging steel according to claim 1, the content of Zr being 0.001 to 0.008% by mass.

3. A thin steel sheet having a thickness of 0.5 mm or less and consisting of the maraging steel according to claim 1.

4. A maraging steel consisting of, in terms of % by mass:
C: ≤0.015%,
Ni: 12.0 to 20.0%,
Mo: 3.0 to 6.0%,
Co: 5.0 to 13.0%,
Al: 0.01 to 0.3%,
Ti: 0.2 to 2.0%,
O: ≤0.0020%,
N: 0.0005 to 0.0020%,
Zr: from 0.001 to 0.02%, and optionally one or more of:
B: from 0.0010 to 0.010%,
Mg: ≤0.003%, and
Ca: ≤0.003%
with the balance being Fe and unavoidable impurities,
wherein the maraging steel comprises at least one TiN or TiCN inclusion with $ZrO_2$ present in a center part thereof and
the maraging steel has a fatigue characteristic, when tested according to the method of JIS Z 2273 (2010), of $10^7$ repetitions or more.

5. The maraging steel according to claim 4, the content of Zr being 0.001 to 0.008% by mass.

6. A thin steel sheet having a thickness of 0.5 mm or less and consisting of the maraging steel according to claim 4.

* * * * *